US007305809B2

(12) United States Patent
Casadei

(10) Patent No.: US 7,305,809 B2
(45) Date of Patent: Dec. 11, 2007

(54) DEVICE FOR CUTTING AND FIXING PLASTIC FILM IN MACHINES FOR WRAPPING PALLETS, AND CORRESPONDING PROCESS

(75) Inventor: Claudio Casadei, Cesena (IT)

(73) Assignee: Mecwrap S.R.L., Villa Calabra di Cesena (FC) (IT)

( * ) Notice: Subject to any disclaimer, the term of this patent is extended or adjusted under 35 U.S.C. 154(b) by 99 days.

(21) Appl. No.: 11/106,647

(22) Filed: Apr. 15, 2005

(65) Prior Publication Data

US 2005/0229544 A1 Oct. 20, 2005

(30) Foreign Application Priority Data

Apr. 15, 2004 (EP) ..... 04425272

(51) Int. Cl.
*B65B 53/00* (2006.01)
*B65B 11/00* (2006.01)

(52) U.S. Cl. ..... 53/556; 53/587; 53/588

(58) Field of Classification Search ..... 53/556, 53/582, 587–589
See application file for complete search history.

(56) References Cited

U.S. PATENT DOCUMENTS 4,204,377 A 5/1980 Lancaster et al.
4,300,326 A 11/1981 Stackhouse
5,452,566 A * 9/1995 Benhamou et al. ..... 53/556
5,564,258 A 10/1996 Jones, Sr. et al.
5,802,810 A 9/1998 Wojcik et al.
6,453,643 B1 9/2002 Buscherini et al.
6,526,729 B1 * 3/2003 Herava ..... 53/465
7,047,707 B2 * 5/2006 Lancaster et al. ..... 53/399

FOREIGN PATENT DOCUMENTS

| | | |
|---|---|---|
| CA | 2383430 | 11/2002 |
| DE | 4100614 A1 | 7/1992 |
| EP | 0713828 A1 | 5/1996 |
| EP | 1426296 A1 | 6/2004 |
| EP | 1449771 A1 | 8/2004 |

* cited by examiner

*Primary Examiner*—Stephen F Gerrity
(74) *Attorney, Agent, or Firm*—Browdy and Neimark, PLLC

(57) ABSTRACT

A device for cutting and fixing plastic film in machines for wrapping pallets comprises: means for spacing (1) at least one layer (2*a*) of the film (2) at a distance from the rest of the wrapping already applied to the pallet (13) so as to create an empty compartment (16) between said layer (2*a*) and the pallet (13); means for deforming (4; 17) said layer (2*a*) of film (2), able to render possible the access to the compartment (16); means for cutting (3) the film (2); means for withholding (8) the film (2) in the proximity of at least one end (7) of the cut film (2); and means for pushing (6) the end (7) of the cut film (2) within the compartment (16). A sequential process enables activation of the aforesaid device so as to perform the corresponding operations in series.

18 Claims, 10 Drawing Sheets

DEVICE FOR CUTTING AND FIXING PLASTIC FILM IN MACHINES FOR WRAPPING PALLETS, AND CORRESPONDING PROCESS

TECHNICAL FIELD

The present invention relates to a device for cutting and fixing plastic film in machines for wrapping palletized loads.

BACKGROUND ART

All machines designed for packaging palletised loads, irrespective of the specific type, present the problem of sealing the plastic film used for wrapping the palletized load at the end of the wrapping operation. The appropriateness of this operation can be readily appreciated in so far as it has the purpose of preventing, during subsequent displacements of the load, the free end of the film from possibly getting caught up, so causing problems, such as, for example, instability of the palletized load or unwinding of the wrapping. Currently, the most widespread methods for sealing plastic film consist in an operation of heat sealing, which constrains the free end of the film to the last layer of the wrapping, or else in the insertion of the free end of the film used for wrapping the palletized load within a sort of pocket obtained by setting at a distance from the load the layers of the film that envelops it.

The first of these operations is frequently carried out using an apparatus for infrared irradiation; the temperature of the film is brought up to approximately 70° C., at which point there is softening of the film and sealing of the free end to the last layers of the wrapping. Alternatively, there is used a contrast bar, which is temporarily inserted underneath the last layers of the wrapping, as well as an appendage at high temperature that compresses the free end of the film against the contrast bar, welding it to the wrapping. However, since in general these machines operate in dusty and crowded environments, the use of high temperatures constitutes a constant source of danger.

Furthermore, with specific reference to the use of these packaging machines in the foodstuff sector, the following factors can prove particularly inconvenient: the production of fumes, which often occurs in the welding of plastic film; the vicinity of the foodstuffs, which is often destined to undergo freezing, to areas at particularly high temperatures; and infrared radiation, with which at least part of the foodstuffs packaged are in any case irradiated.

The second operation is obtained with a mechanical apparatus characterized by the simultaneous action of a spacer member, which separates the last layers of the film from the underlying ones, and an insertion member, which pushes the free end of the film into the pocket formed by the spacing of the film at a distance from the load.

The main limit of the above process is linked to the difficult synchronization of the two devices, operation of which, controlled by pneumatic pistons, must take into account the marked elastic characteristics of the film: in other words, it may occur that even a slight variation (in the region of the tenth of a second) of the times of operation of the pistons will cause an early release of the pocket or of the free end of the film. In the first case, which is the less serious one, the spacer member can remain imprisoned in the pocket, but, thanks to an appropriate shaping, can slide out just by leaving a slight decrease in the tensioning of the film; in the second case, instead, and with rather more serious consequences, the free end of the film would escape, rendering the sealing operation vain.

SUMMARY OF THE PRESENT INVENTION

The purpose of the present invention is consequently to eliminate the drawbacks mentioned above. This purpose is achieved thanks to a device that intervenes first on the penultimate layer of the wrapping, deforming it, and then pushing the free end of the film beyond said layer, between the layer and the rest of the wrapping.

The main advantage obtained by means of the present invention basically consists in the fact that it in no way runs any risk of the final end of the film remaining free and not fixed to the rest of the wrapping.

Furthermore, the use of a mechanical device enables prevention of any drawback deriving from the use of high temperatures, such as, for example, the risk of accidents, the production of fumes, or the deterioration of the goods packaged.

Finally, the sequential nature of the operation of the device enables prevention a priori of any malfunctioning deriving from the faulty operation of the activation mechanism.

BRIEF DESCRIPTION OF THE DRAWINGS

Further advantages and characteristics of the invention will emerge more evidently from the ensuing detailed description, provided with reference to the attached drawings, which represent a non-limiting example of embodiment thereof, and in which.

DETAILED DESCRIPTION OF THE PREFERRED EMBODIMENTS

Figure 1A:
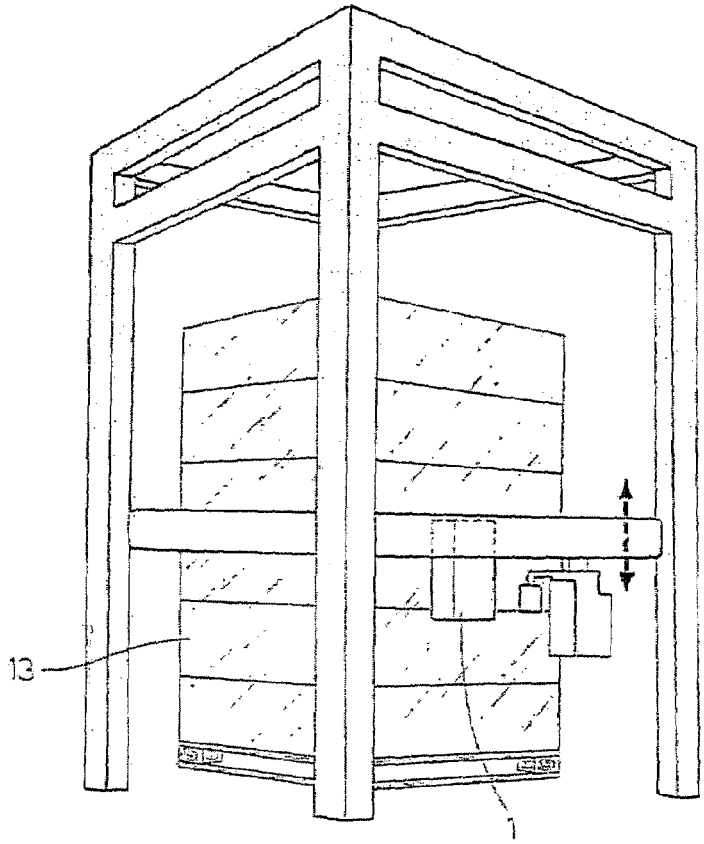
FIG. 1A is a schematic illustration of the invention according to a front perspective view.
Figure 1B:
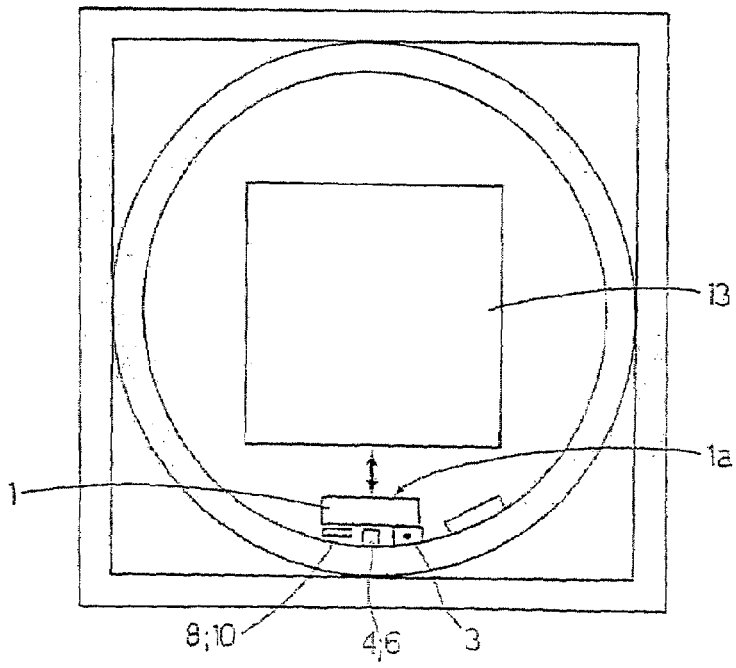
FIG. 1B is a schematic illustration of the invention according to a plan view from above.
Figure 2:
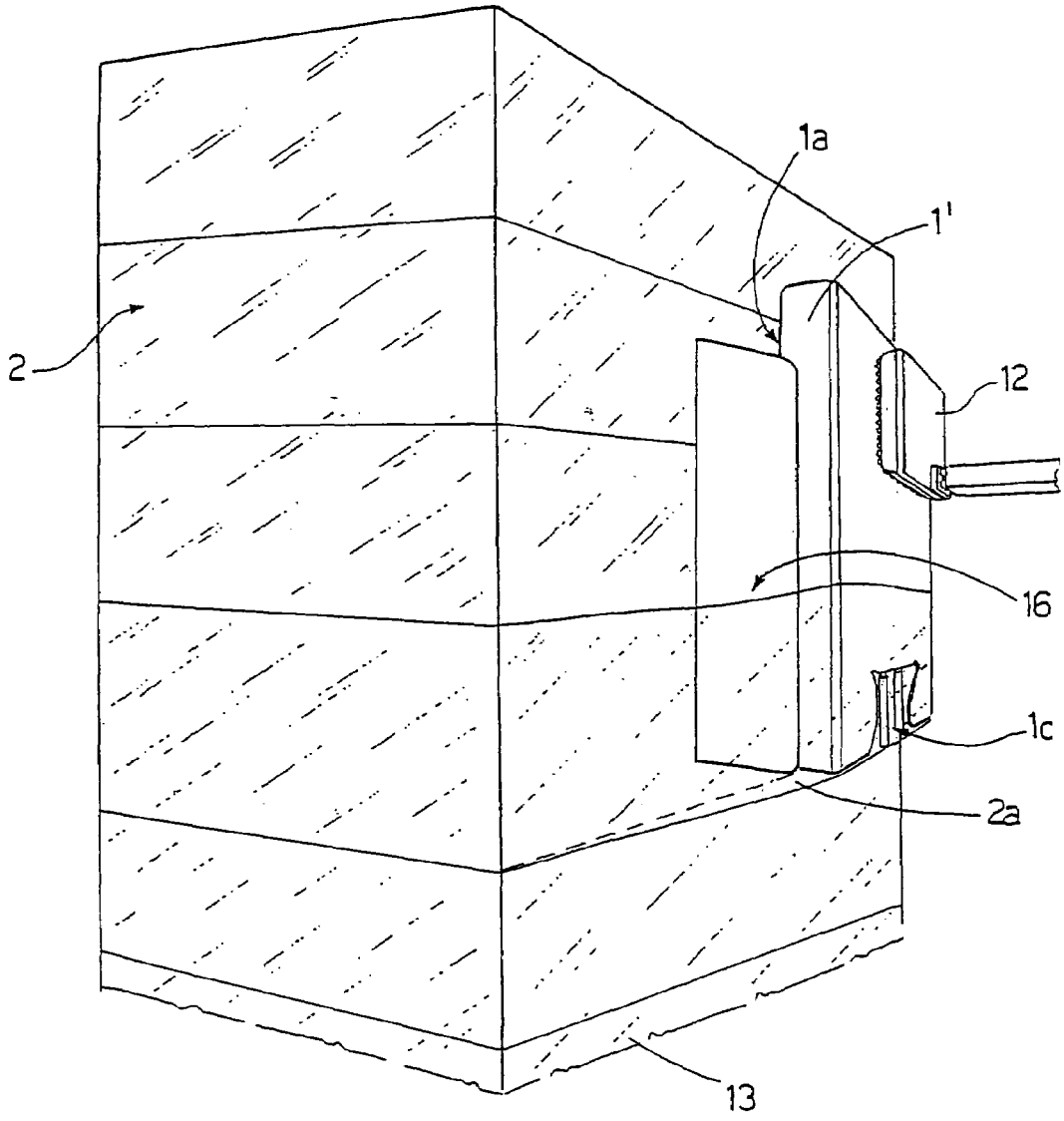
FIG. 2 illustrates the invention according to a first embodiment, in a first operative position.

As may be seen from the figures, the invention relates to a device for cutting and fixing plastic film in machines for wrapping palletized loads. It comprises: means for spacing (1) at least one layer (2*a*) of the film (2) from the rest of the wrapping already applied on the palletized load (13) so as to create an empty compartment (16) between this layer (2*a*) and the palletized load (13); means for cutting (3) the film (2), and means for withholding (8) the film (2) in the proximity of at least one end (7) of the cut film (2), as well as means for deforming (4; 17) at least said layer (2*a*) of the film (2), able to render possible the access to the compartment (16); and means for pushing (6) the end (7) of the cut film (2) inside the compartment (16).

In addition, it is advantageous that the device comprises also means for stabilizing (10) insertion of the end (7) of the film (2) within the compartment (16), in such a way as to prevent it from coming out. Said means for stabilizing (10), in the solution represented in the figures, are constituted by a mobile plate (12), able to compress said layer (2*a*) and the end (7) of the film (2) against the rest of the wrapping.

For convenience of construction, even though it is not strictly necessary, the means for withholding (8) the film (2) in the proximity of at least one end (7) of the cut film (2) and the means for stabilizing (10) the insertion of the end (7) of the film (2) within the compartment (16) are constituted by a single mobile plate (12).

The means for pushing (6) the end (7) of the cut film (2) within the compartment (16) comprise: a mobile element (11), designed to intercept the end (7) of the cut film (2) and to bring it beyond the layer (2*a*) of film (2); and means for folding (9) the end (7) of the film (2) within the compartment (16).

The means for deforming (4; 17) the layer (2*a*) of film (2) set at a distance from the palletized load (13) can be obtained in various ways. In FIGS. 2 to 7, they are constituted by means for perforating (4) this layer (2*a*) of film (2), so as to provide a hole (5) in which the cut end (7) will then be inserted.

In this solution of embodiment, even though it is possible to use different tools for carrying out the operations of perforating the film (2) and of inserting the cut end (7) within the hole (5), it is, however, evident that use of a single accessory provides immediate guarantee of correct positioning of the cut end (7) with respect to the hole (5).

Consequently, in the solution represented, the means for perforating (4) the layer (2*a*) of the film (2), and the means for pushing (6) the end (7) of the film (2) into the compartment (16) comprise a single mobile element (11).

Alternatively, in FIGS. 8 to 11, the means) for deforming (4; 17) the layer (2*a*) of film (2) set at a distance from the palletized load (13) comprise means for dragging (17) said layer (2*a*), designed to intercept the top edge thereof to be able to lower it.

They comprise at least one hook (18), which can move from a resting position, in which it does not interfere with the layer (2*a*) of film (2), to a working position, in which it keeps the top edge of this layer (2*a*) of film lowered, so as to free access to the compartment (16). Structurally, in the examples of embodiment represented in the figures, the means for spacing (1) at a distance from the rest of the wrapping the layer (2*a*) of the film (2) which should be deformed comprise a hollow solid (1'), which can move from a resting position, in which it does not interfere with the wrapping of the film (2) on the palletized load (13), to a working position, in which, resting on the palletized load (13) with one of its own plane surfaces (1*a*), it spaces the successive layers (2*a*) of film (2) at a distance from the surface of the palletized load (13). This hollow solid (1') is provided with a sensor (1*b*), designed to signal when the solid (1') is in contact with the palletized load (13), so as to interrupt movement thereof. Furthermore, inside it, the hollow solid (1') houses the means for folding (9) the end (7) of the film (2) within the hole (5), said means for folding (9) being constituted by a blowing element (9') that emits air under pressure. In the wall in contact with the layer (2*a*) of film (2) which should be deformed, the hollow solid (1') has a window (1*c*), which enables identification of the area of intervention of the means for pushing (6) the cut end (7) of the film (2) within the compartment (16).

The mobile element (11), shaped so as to be also suitable for cutting the film (2), is mounted on first extensible rectilinear guides (14) in such a way as to be able to pass repeatedly from a retracted resting position to an extracted working position. In the solution which envisages perforating the layer (2*a*) of film (2), it first makes a hole and then pushes the end (7) of the film (2) inside the hole (5). In the solution which envisages lowering the edge of the layer (2*a*) of the film (2), it pushes only the cut end (7) of the film (2) right onto the edge of the compartment (16).

Second extensible rectilinear guides (15) are instead designed for supporting the plate (12) in such a way that this can pass from a retracted resting position to two distinct extracted working positions, in the first of which, with the guides (15) partially extended, it withholds the end (7) of the cut film (2) for preventing elastic return thereof, and in the second of which, with the guides (15) further extended, it compresses the layer (2*a*) and the end (7) of the film (2) against the rest of the wrapping already spread out on the palletized load (13).

The process used by the device described above comprises, in the first place, a step in which at least one layer (2*a*) of the film (2) is set at a distance from the rest of the wrapping already spread out on the palletized load (13), thus creating an empty compartment (16). This is obtained by bringing the hollow solid (1') to rest on the palletized load (13) with one of its own walls (1*a*), as may be seen in FIGS. 2 and 8.

Then, said layer (2*a*) of film (2) is deformed so as to render the compartment (16) accessible.

It is only at this point that an operator assembly (19) is actuated, which enables cutting and fixing of the plastic film (2). The operator assembly (19), which comprises the mobile element (11) and the plate (12), moves down until the mobile element (11) is in front of the window (1*c*) of the hollow solid (1').

Figure 3:
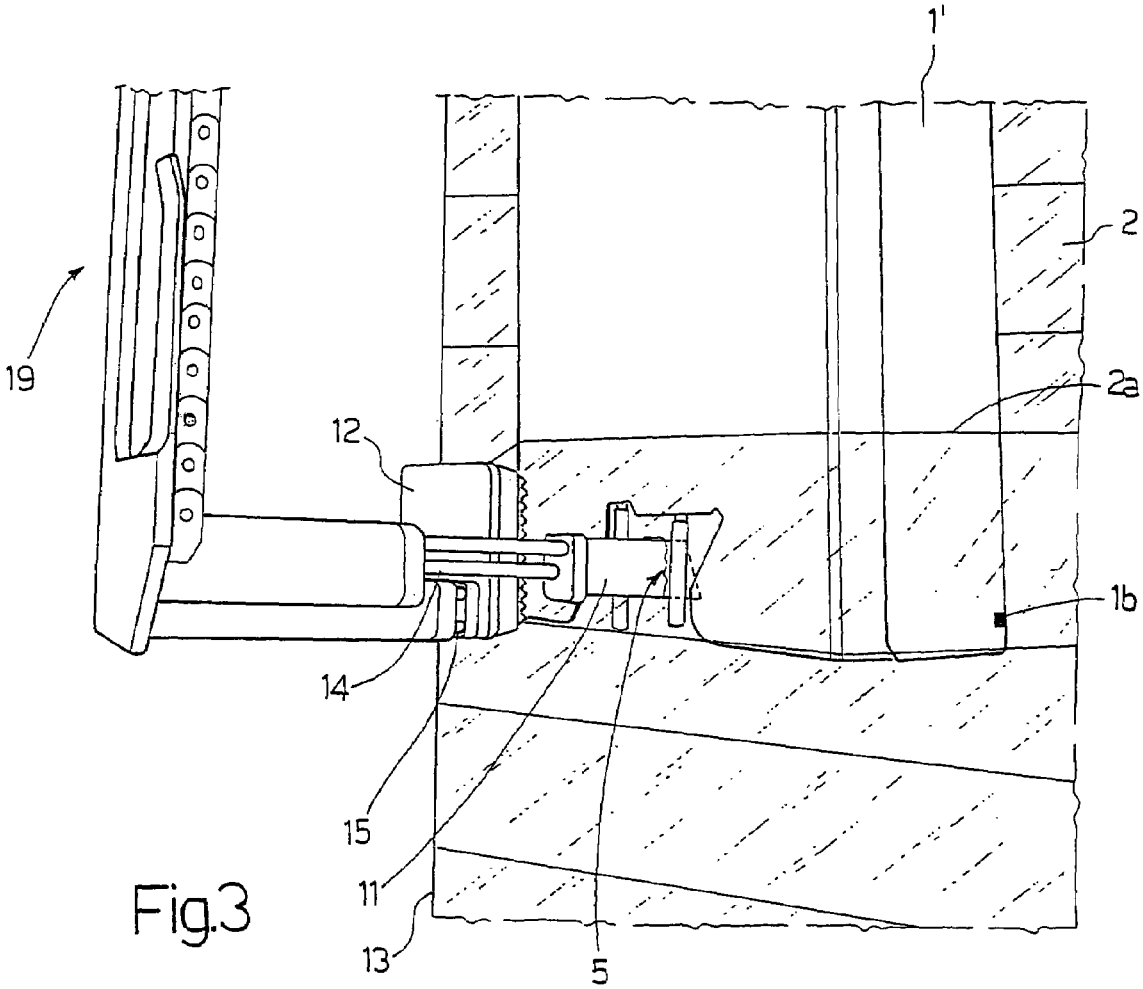
FIG. 3 illustrates the invention according to a first embodiment, in a second operative position.
Figure 4:
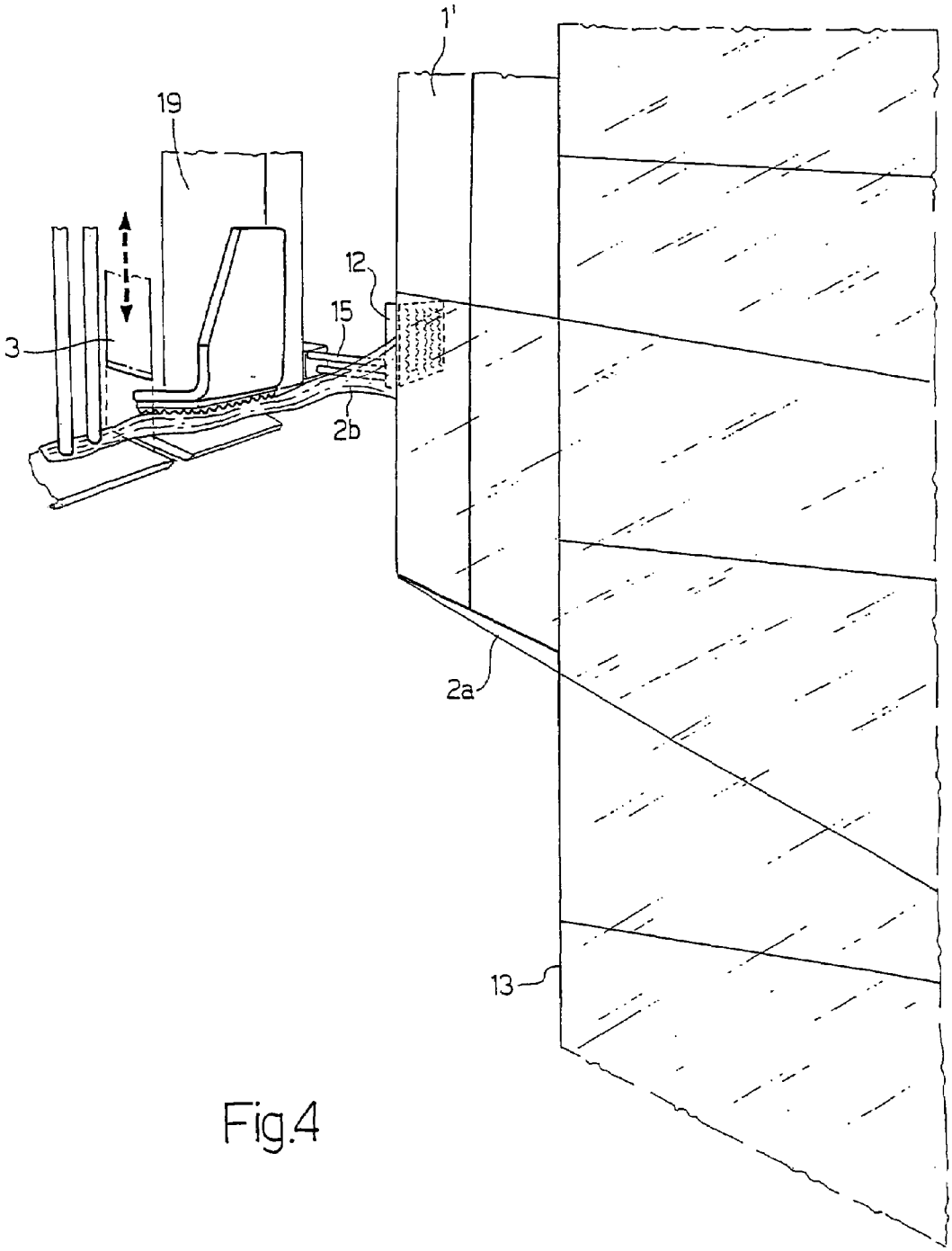
FIG. 4 illustrates the invention according to a first embodiment, in a third operative position.

At this point, according to a first solution, the mobile element (11), as may be seen from FIG. 3, first makes a hole (5) in the layer (2*a*) of the film (2), in a position corresponding to the aforesaid window (1*c*), thanks to a there and back travel of the rectilinear guides (14) on which it is mounted, and then, as may be seen in FIG. 4, after a last layer (2*b*) of film (2) has been laid out and has been tapered in correspondence of the cutting area, the operator assembly (19) withholds the film (2) in the proximity of at least one end (7) of the film (2) to be cut thanks to a partial lengthening of the second rectilinear guides (15) that support the plate (12). This enables that subsequently, when the film is cut, the cut end (7) will not escape as a result of the elasticity of the film (2) itself.

Figure 5A:
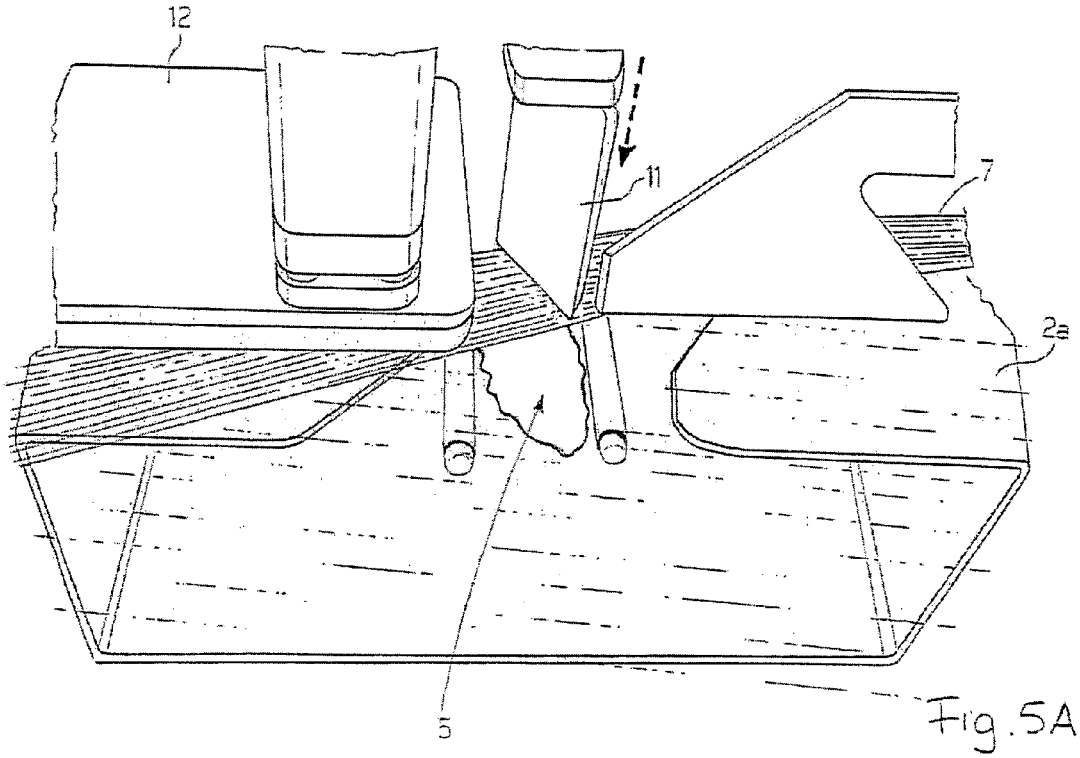
FIG. 5A illustrates the invention according to a first embodiment, in a forth operative position.
Figure 5B:
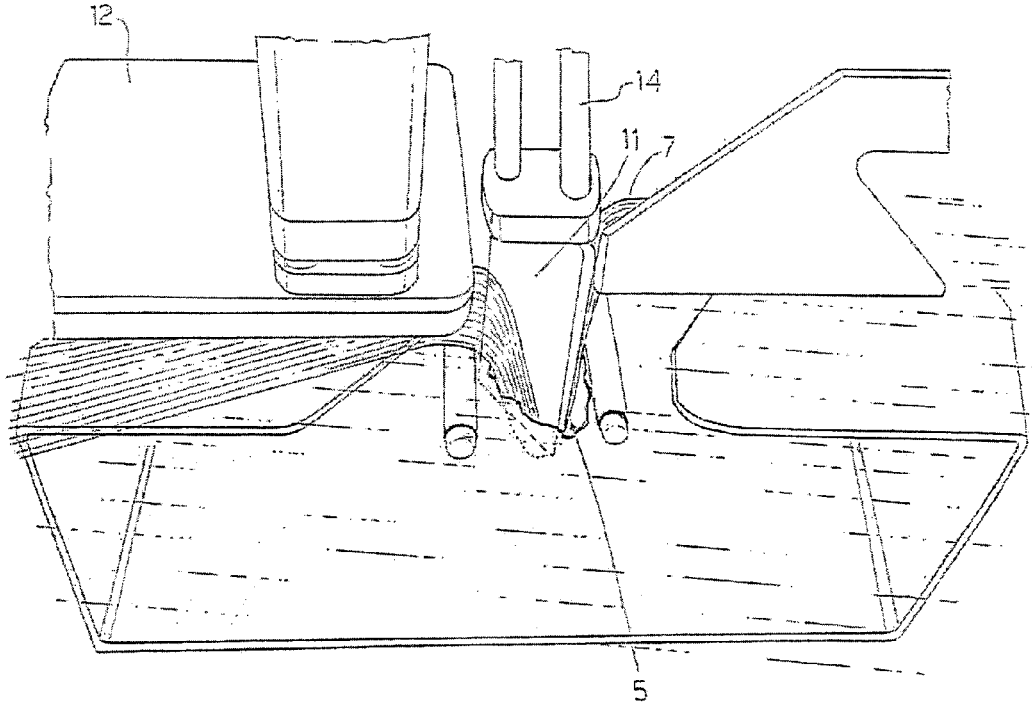
FIG. 5B illustrates the invention according to a first embodiment, in a fifth operative position.
Figure 6:
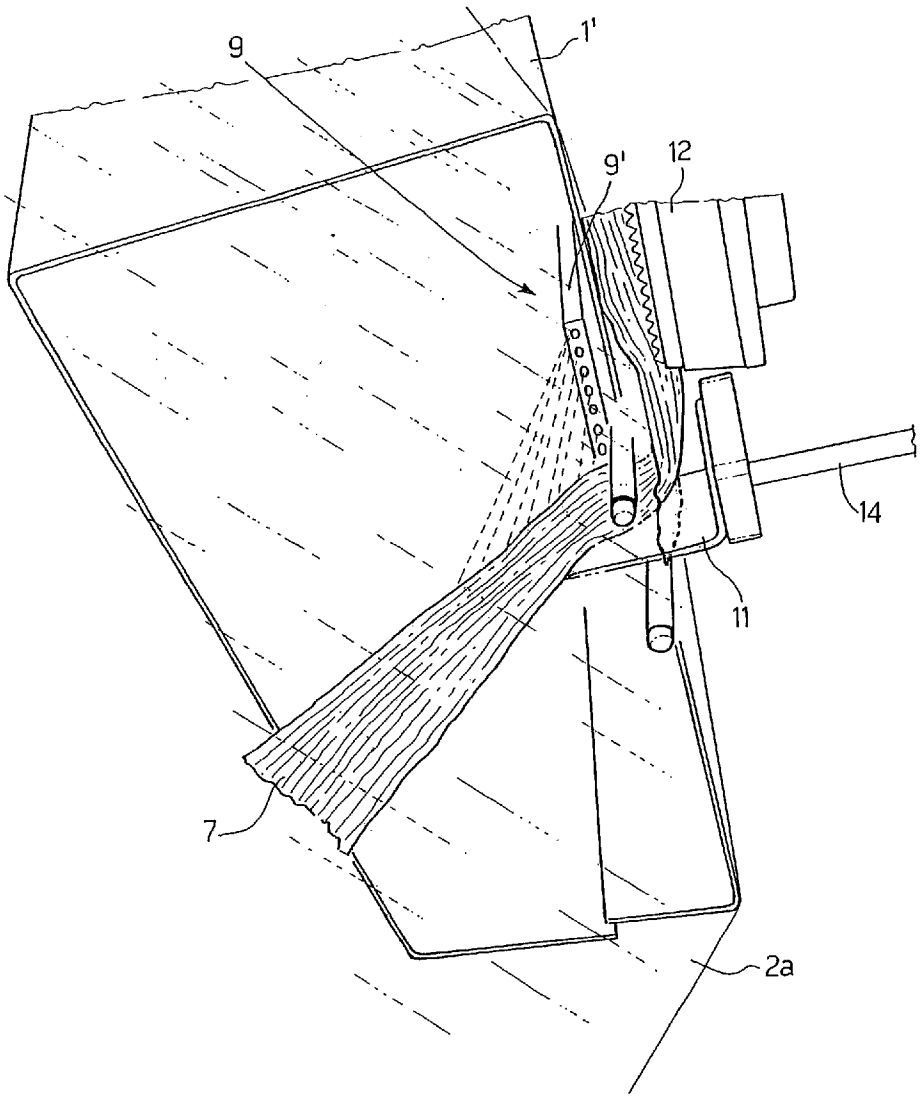
FIG. 6 illustrates the invention according to a first embodiment, in a sixth operative position.
Figure 7A:
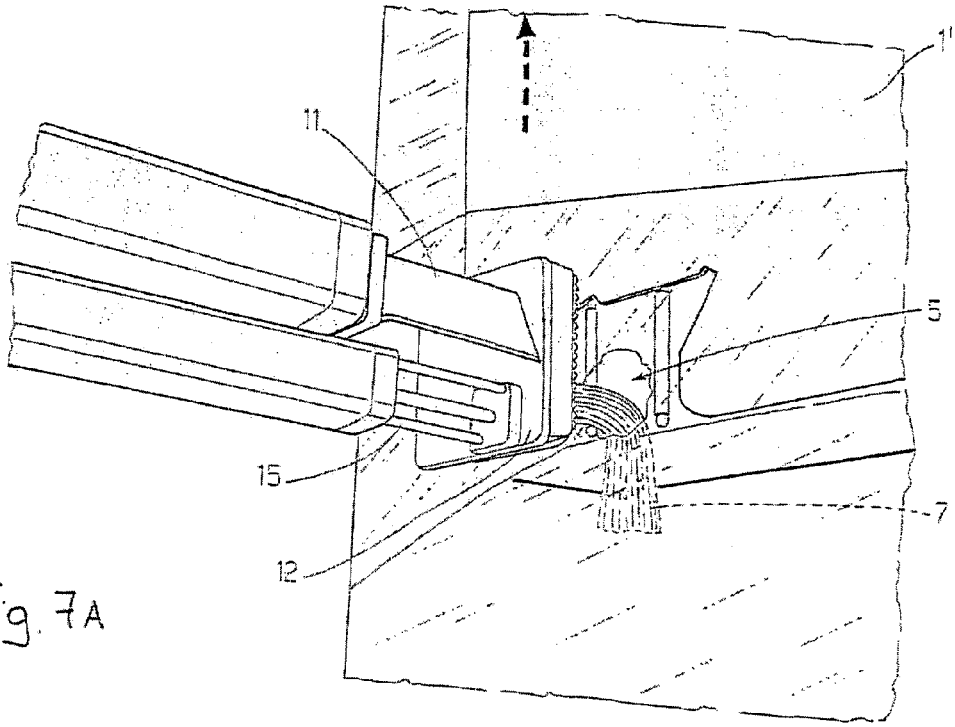
FIG. 7A illustrates the invention according to a first embodiment, in a seventh operative position.
Figure 7B:
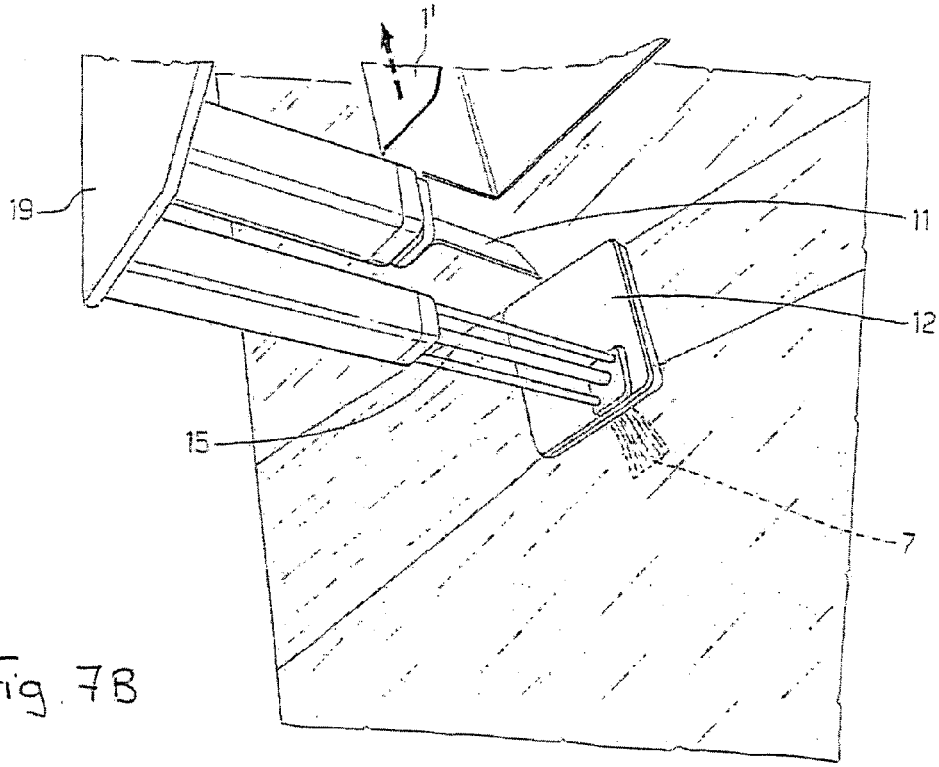
FIG. 7B illustrates the invention according to a first embodiment, in a eight operative position.
Figure 8:
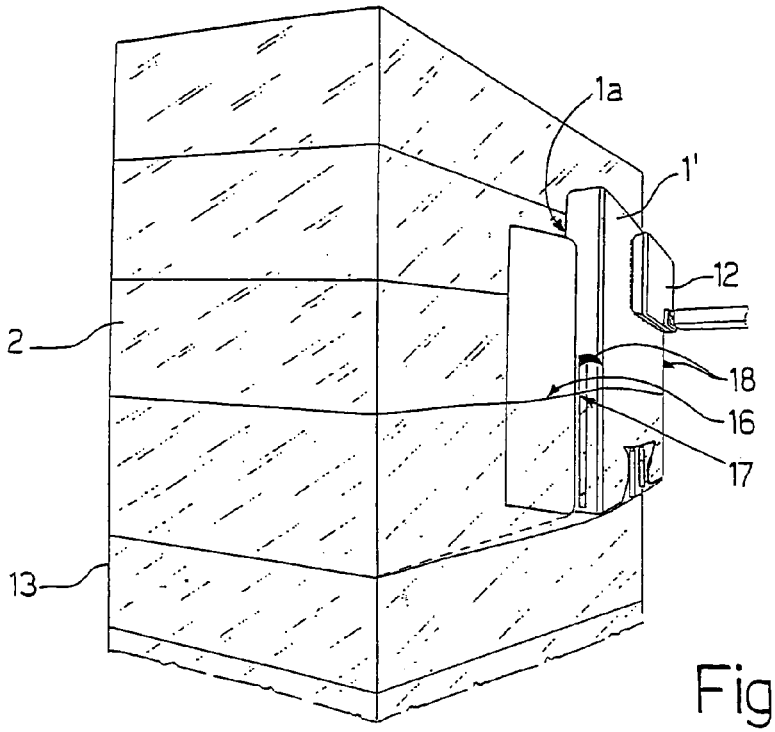
FIG. 8 illustrates the invention according to a second embodiment, in a first operative position.
Figure 9:
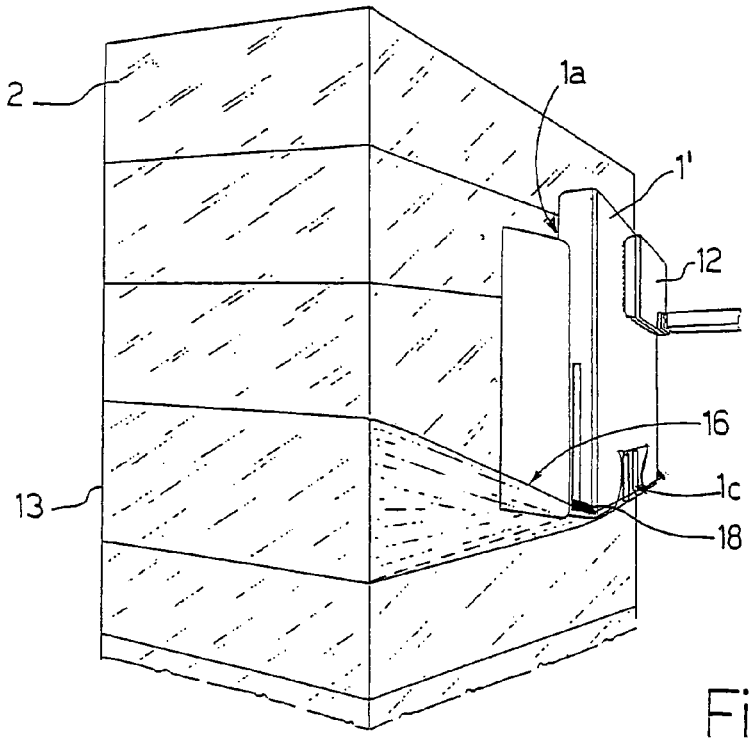
FIG. 9 illustrates the invention according to a second embodiment, in a second operative position.

Finally, a second there and back travel of the first rectilinear guides (14) causes the mobile element (11) to drag the cut end (7) of the film (2), introducing it into the hole (5), as may be seen in FIG. 5. At this point, as is represented in FIG. 6, an operation of folding of the end (7) of the film (2) takes place after its insertion into the hole (5), on which end (7) the blowing element (9') housed inside the hollow solid (1') emits air under pressure.

Even though it is not absolutely necessary, it is convenient for the process to comprise also an operation of compression of the perforated layer (2*a*) and of the end (7) of the cut film (2) against the rest of the wrapping, as represented in FIG.

7. This operation is carried out, after the hollow solid (1') has returned into its own resting position, thanks to a further lengthening of the second rectilinear guides (15), which is designed to bring the plate (12) up against the palletized load (13).

According to a second solution, alternative to that of making the hole (5) in the layer (2*a*) of film (2), the deformation of said layer (2*a*) is obtained by lowering its edge. To do this, as may be seen in FIGS. 8 and 9, hooks (18), mounted on the hollow solid (1'), slide vertically until they intercept the edge of the layer (2*a*) of film (2), keeping it lowered to enable access to the compartment (16).

Figure 10A:
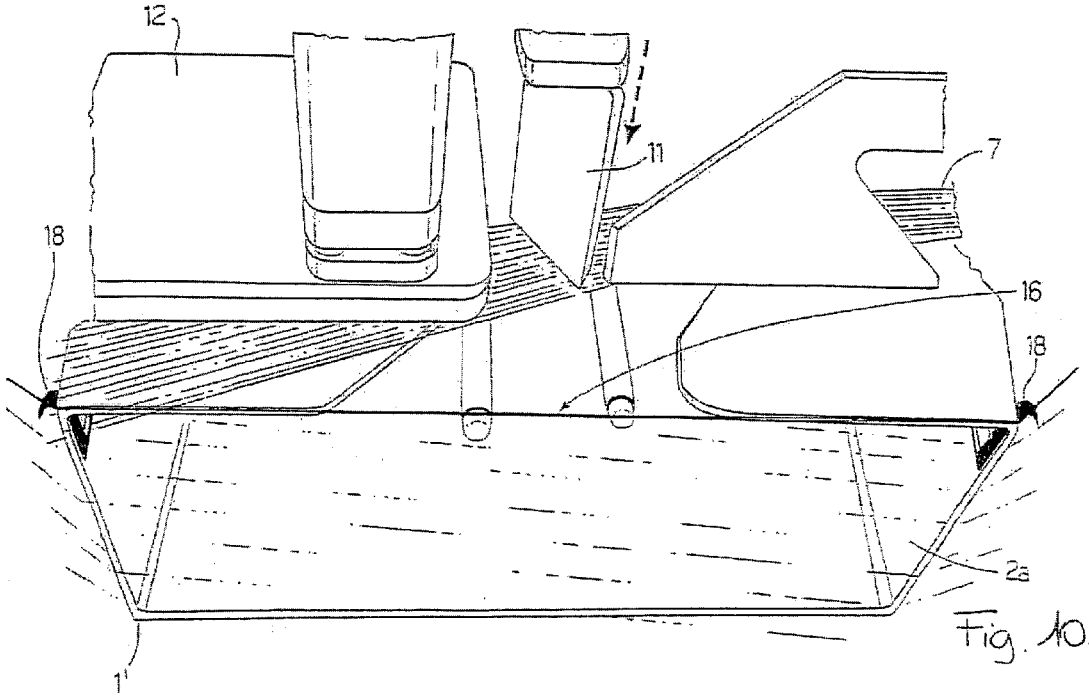
FIG. 10A illustrates the invention according to a second embodiment, in a third operative position.
Figure 10B:
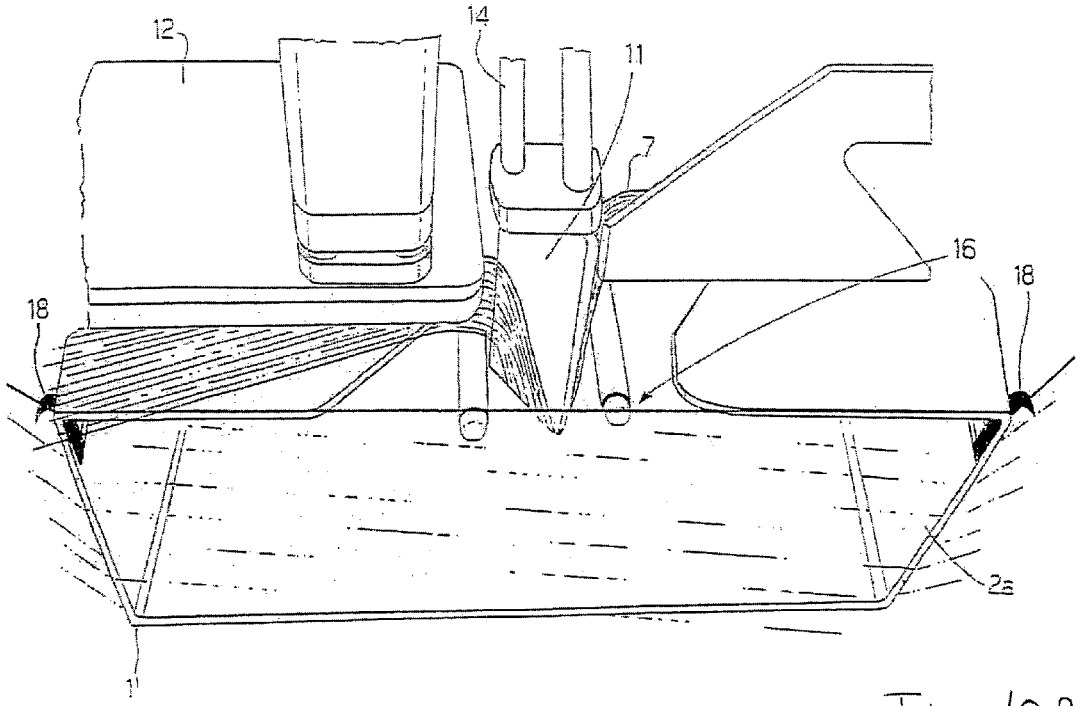
FIG. 10B illustrates the invention according to a second embodiment, in a fourth operative position.
Figure 11:
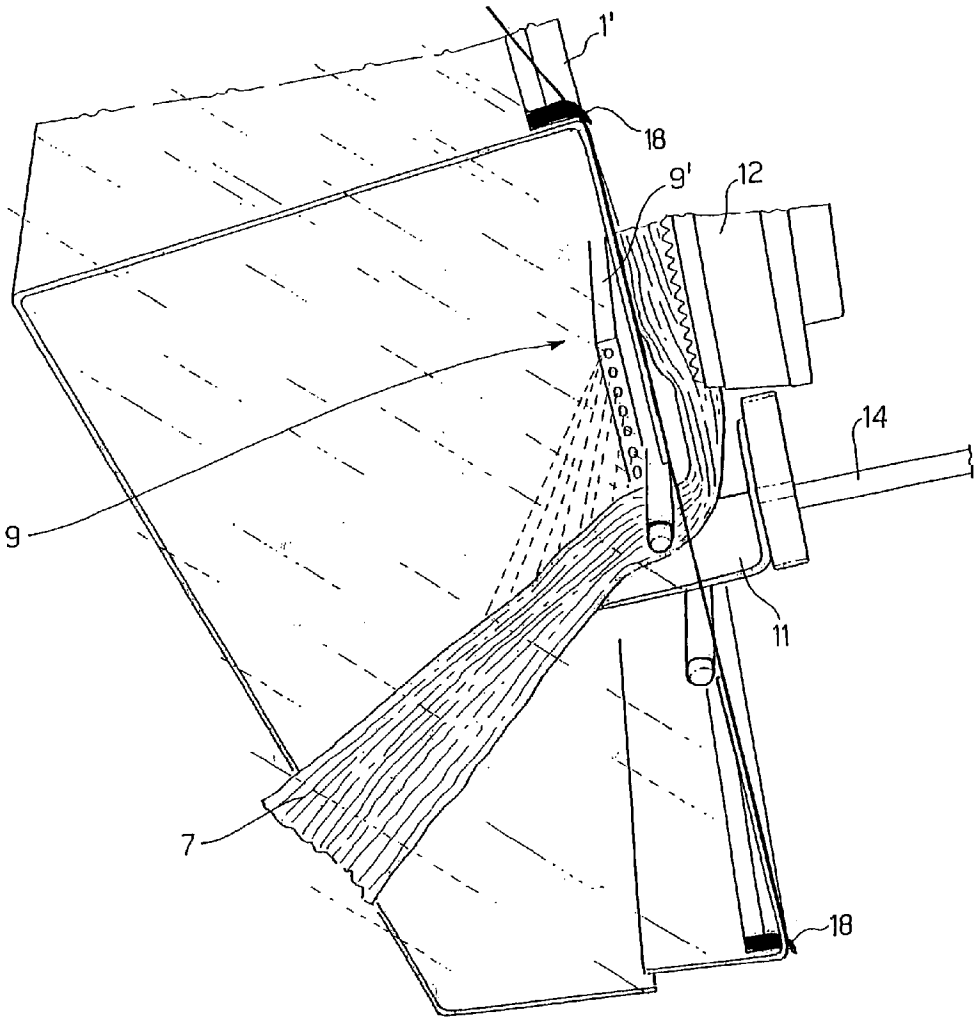
FIG. 11 illustrates the invention according to a second embodiment, in a fifth operative position.

Then, once the last layer (2*b*) of film (2) has been spread out, the process, visible in FIGS. 10 and 11, continues unaltered with cutting of the film (2) and transfer of the cut end (7) by the mobile element (11) beyond the edge of the layer (2*a*) of film (2) above the compartment (16), where it is folded downwards by the action of the blowing element (9').

The sequentiality of the operations described enables simple automatic control thereof and rules out occurrence of potential accidents, given that any failure to execute one of the aforesaid operations causes an immediate arrest of the entire process.

What is claimed is:

1. A device for cutting and fixing plastic film in machines for wrapping palletized loads, comprising: means for spacing (1) at least one layer (2*a*) of the film (2) at a distance from the rest of the wrapping already applied to the palletized load (13) so as to create an empty compartment (16) between said layer (2*a*) and the palletized load (13); means for cutting (3) the film (2); and means for withholding (8) the film (2) in the proximity of at least one end (7) of the cut film (2), wherein said device comprises means for deforming (4; 17) said layer (2*a*) of film (2) so as to enable access to said compartment (16), and means for pushing (6) the end (7) of the cut film (2) within the compartment (16).

2. The device according to claim 1, further comprising means for stabilizing (10) the insertion of the end (7) of the film (2) within the compartment (16) in such a way as to prevent the end (7) of the film (2) coming out from the compartment (16).

3. The device according to claim 1 or claim 2, wherein the means for pushing (6) the end (7) of the cut film (2) into the compartment (16) comprise a mobile element (11), able to intercept the end (7) of the cut film (2) and to bring the end (7) of the cut film (2) beyond the layer (2*a*) of film (2), and means for folding (9) the end (7) of the film (2) within the compartment (16).

4. The device according to claim 3, wherein the device comprises first extensible rectilinear guides (14), on which there is mounted the mobile element (11), which first extensible rectilinear guides pass the mobile element (11) from a retracted position to an extracted position, to bring the end (7) of the cut film (2) beyond the layer (2*a*) of film (2).

5. The device according to claim 2, wherein the means for stabilizing (10) comprise a mobile plate (12), designed to compress said layer (2*a*) and the end (7) of the film (2) against the rest of the wrapping.

6. The device according to claim 2, wherein the means for withholding (8) the film (2) in the proximity of at least one end (7) of the cut film (2) and the means for stabilizing (10) insertion of the end (7) of the film (2) within the compartment (16) are constituted by a single mobile plate (12).

7. The device according to claim 6, wherein the device comprises second extensible rectilinear guides (15), on which there is mounted the plate (12), which second extensible rectilinear guides pass the plate (12) from a retracted resting position to two distinct extracted working positions, in the first one of which, with the guides (15) partially extended, the plate (12) withholds the end (7) of the cut film (2) for preventing elastic return thereof, and in the second one of which, with the guides (15) further extended, it compresses the layer (2*a*) and the end (7) of the film (2) against the rest of the wrapping.

8. The device according to claim 1, wherein the means for spacing (1) at least said layer (2*a*) of the film (2) at a distance from the rest of the wrapping comprise a hollow solid (1') which can move from a resting position, in which the hollow solid (1') does not interfere with the wrapping of the film (2) on the palletized load (13), to a working position, in which, resting on the palletized load (13) with one of its own plane surfaces (1*a*), the hollow solid (1') spaces the successive layers (2*a*) of film (2) at a distance from the surface of the palletized load (13).

9. The device according to claim 8, wherein said hollow solid (1') is provided with a sensor (1*b*), which sensor is able to signal when the solid (1') is in contact with the palletized load (13) so as to interrupt movement thereof.

10. The device according to claim 8, wherein said hollow solid (1') houses inside means for folding (9) said end (7) of the film (2) within the compartment (16).

11. The device according to claim 10, wherein the means for folding (9) the end (7) of the film (2) comprise a blowing element (9') that emits air under pressure.

12. The device according to claim 8, wherein the hollow solid (1') has a window (1*c*), which window is able to identify the area in which a mobile element (11) brings the end (7) of the cut film (2) beyond the layer (2*a*) of film (2).

13. The device according to claim 1, wherein the means for deforming (4; 17) said layer (2*a*) of film (2) comprise at least means for dragging (17) said layer (2*a*) of film (2), designed to intercept the top edge thereof in order to lower said layer (2*a*) of film (2).

14. The device according to claim 13, wherein the means for dragging (17) comprise at least one hook (18), which can move from a resting position, in which the hook (18) does not interfere with said layer (2*a*) of film (2), to a working position, in which the hook (18) keeps the top edge of said layer (2*a*) of film (2) lowered so as to free access to the compartment (16).

15. The device according to claim 1, wherein the means for deforming (4; 17) said layer (2*a*) of film (2) comprise at least means for perforating (4) said layer (2*a*) of film (2) in such a way as to make a hole (5) in the film (2) supported by said means for spacing (1).

16. The device according to claim 15, wherein the means for perforating (4) comprise a mobile element (11), able to pass from a retracted resting position, in which the mobile element (11) does not interfere with said layer (2*a*) of film (2), to an extracted working position, in which the mobile element (11) tears said layer (2*a*) of film (2), and vice versa.

17. The device according to claim 16, wherein the means for perforating (4) said layer (2*a*) of film (2) and the means for pushing (6) the end (7) of the cut film (2) into the compartment (16) comprise a single mobile element (11) so as to guarantee insertion of the end (7) of the film (2) within the hole (5).

18. The device according to claim 17, wherein the device comprises first extensible rectilinear guides (14), on which there is mounted the mobile element (11) in such a way as to pass repeatedly from a retracted resting position to an extracted working position, in which the mobile element (11) first makes a hole in said layer (2*a*) of the film (2) and next pushes the end (7) of the film (2) within the hole (5).

* * * * *